US009388670B2

(12) United States Patent
Vu et al.

(10) Patent No.: US 9,388,670 B2
(45) Date of Patent: Jul. 12, 2016

(54) CONTAINMENT SYSTEM AND A METHOD FOR USING SAID CONTAINMENT SYSTEM

(71) Applicant: TOTAL SA, Courbevoie (FR)

(72) Inventors: Van-Khoi Vu, Pau (FR); Jean-Claude Bourguignon, Pau (FR)

(73) Assignee: Total SA, Courbevoie (FR)

( * ) Notice: Subject to any disclaimer, the term of this patent is extended or adjusted under 35 U.S.C. 154(b) by 0 days.

(21) Appl. No.: 14/426,287

(22) PCT Filed: Jul. 19, 2013

(86) PCT No.: PCT/EP2013/065359

§ 371 (c)(1),
(2) Date: Mar. 5, 2015

(87) PCT Pub. No.: WO2014/037141

PCT Pub. Date: Mar. 13, 2014

(65) Prior Publication Data

US 2015/0226039 A1 Aug. 13, 2015

Related U.S. Application Data

(60) Provisional application No. 61/698,269, filed on Sep. 7, 2012.

(51) Int. Cl.
*E02B 15/04* (2006.01)
*E21B 43/01* (2006.01)
(Continued)

(52) U.S. Cl.
CPC ..... *E21B 43/0122* (2013.01); *E02B 15/04* (2013.01); *E21B 43/01* (2013.01); *E21B 43/16* (2013.01); *E02B 2015/005* (2013.01)

(58) Field of Classification Search
CPC ..... E21B 43/0122; E02B 2015/005; E02B 15/00; E02B 15/04; E02B 15/045; E02B 15/046
USPC ..... 405/60, 64
See application file for complete search history.

(56) References Cited

U.S. PATENT DOCUMENTS 3,643,741 A * 2/1972 Miranda ..... E21B 3/0122 166/295
3,667,605 A 6/1972 Zielinski
(Continued)

FOREIGN PATENT DOCUMENTS

FR 2804935 A1 * 8/2001 ..... B63C 7/006
FR 2961843 12/2011
(Continued)

OTHER PUBLICATIONS

Notification of Transmittal, International Search Report and the Written Opinion of the International Searching Authority for PCT/EP2013/065359, mailed Apr. 22, 2014, 9 pgs.
(Continued)

*Primary Examiner* — Frederick L Lagman
(74) *Attorney, Agent, or Firm* — Patterson Thuente Pedersen, P.A.

(57) ABSTRACT

A containment system for recovering hydrocarbon fluid from a leaking device comprises a dome situated above the leaking device and forming a cavity for accumulating hydrocarbon fluid from the leaking device, and an injection system that inputs an injection fluid into the cavity. The injection system comprises a plurality of first injectors near the domes inner surface.

19 Claims, 6 Drawing Sheets

(51) Int. Cl.
*E21B 43/16* (2006.01)
*E02B 15/00* (2006.01)

(56) References Cited

U.S. PATENT DOCUMENTS

| | | | | |
|---|---|---|---|---|
| 3,762,548 | A * | 10/1973 | McCabe | B01D 17/0208 210/170.11 |
| 4,395,157 | A | 7/1983 | Cunningham | |
| 4,531,860 | A | 7/1985 | Barnett | |
| 5,213,444 | A | 5/1993 | Henning | |
| 8,025,103 | B1 * | 9/2011 | Wolinsky | E21B 43/0122 166/356 |
| 2006/0283590 | A1 | 12/2006 | Poldervaart | |
| 2011/0274493 | A1 | 11/2011 | Cutts | |
| 2011/0293372 | A1 | 12/2011 | Later | |
| 2011/0299929 | A1 | 12/2011 | Sabourin | |
| 2011/0315233 | A1 | 12/2011 | Carter | |
| 2011/0315393 | A1 * | 12/2011 | Wolinsky | E21B 43/0122 166/363 |
| 2011/0315396 | A1 * | 12/2011 | Wolinsky | E21B 43/0122 166/363 |
| 2012/0024533 | A1 | 2/2012 | Ivic | |
| 2012/0051840 | A1 | 3/2012 | Hatton | |
| 2012/0073823 | A1 * | 3/2012 | McClanahan | B01D 19/0073 166/344 |
| 2012/0087729 | A1 | 4/2012 | Oesterberg et al. | |
| 2012/0118580 | A1 | 5/2012 | Swanson et al. | |
| 2012/0125623 | A1 * | 5/2012 | Cargol, Jr. | E21B 43/0122 166/344 |
| 2012/0155964 | A1 | 6/2012 | Carter et al. | |
| 2012/0181041 | A1 * | 7/2012 | Willman | E02F 3/925 166/357 |
| 2012/0186822 | A1 | 7/2012 | Mahajan | |
| 2012/0213588 | A1 | 8/2012 | Shifferaw | |
| 2012/0247781 | A1 * | 10/2012 | Noble | E21B 43/0122 166/344 |
| 2012/0251244 | A1 | 10/2012 | Toedtman | |
| 2013/0046126 | A1 | 2/2013 | Varney et al. | |
| 2013/0074757 | A1 | 3/2013 | McAlister | |
| 2013/0118754 | A1 | 5/2013 | Worrall et al. | |
| 2013/0177356 | A1 | 7/2013 | Edmondson | |
| 2013/0183098 | A1 | 7/2013 | Halal et al. | |
| 2013/0270194 | A1 | 10/2013 | Allen | |
| 2014/0356068 | A1 | 12/2014 | Andritsos et al. | |

FOREIGN PATENT DOCUMENTS

| | | | |
|---|---|---|---|
| FR | 2972216 | | 9/2012 |
| GB | 2480112 | A | 11/2011 |
| WO | WO 2011/154733 | A1 | 12/2011 |
| WO | WO 2011/163239 | A1 | 12/2011 |
| WO | WO 2011/163573 | A2 | 12/2011 |
| WO | WO 2012/050823 | A2 | 4/2012 |

OTHER PUBLICATIONS

International Application No. PCT/EP2013/068640, filed Sep. 9, 2013, International Search report, mailed May 22, 2014, 4 pages.

International Application No. PCT/EP2013/068644, filed Sep. 9, 2013, International Search report, mailed May 9, 2014, 3 pages.

Application and File History for U.S. Appl. No. 14/425,622, filed Mar. 3, 2015, Inventors: Vu et al.

Application and File History for U.S. Appl. No. 14/426,244, filed Mar. 5, 2015, Inventors: Vu et al.

* cited by examiner

CONTAINMENT SYSTEM AND A METHOD FOR USING SAID CONTAINMENT SYSTEM

RELATED APPLICATIONS

The present application is a National Phase entry of PCT Application No. PCT/EP2013/065359, filed Jul. 19, 2013, which claims priority from U.S. Patent Application No. 61/698,269 filed Sep. 7, 2012, said applications being hereby incorporated by reference herein in their entirety.

FIELD OF THE INVENTION

The present invention concerns a containment system for recovering spilled oil that is leaking under water.

BACKGROUND OF THE INVENTION

The present invention concerns more precisely a containment system for recovering a hydrocarbon fluid from a leaking device that is situated at the seafloor and that is leaking the hydrocarbon fluid from a well.

Recovering oil that is leaking from an under water oil device is a great problem, especially for oil devices that are installed at deep sea floor.

The explosion on the "Deepwater Horizon" platform in the Gulf of Mexico demonstrated how much such a containment system is difficult to control.

One of the main problems was the formation of hydrates that clogged the used containment system.

For example, at a depth of around 1500 meters, the sea water is cold (for example around only 5° C.) and at a high pressure. These environmental conditions may transform the sea water and hydrocarbon fluid into hydrates having a quasi-solid phase and which can fill and clog any cavity.

OBJECTS AND SUMMARY OF THE INVENTION

One object of the present invention is to provide a containment system that avoids the formation of hydrates inside the dome. More specifically, the aim of the invention is to provide a containment system having a large dome and a large cavity volume that avoids said formation of hydrates.

To this effect, the containment system of the present invention comprises:

- a dome situated above the leaking device and surrounding said leaking device, and forming a cavity under said dome, said cavity being adapted for accumulating hydrocarbon fluid coming upwardly from the leaking device, said dome comprising at least one upper output opening adapted to extract the hydrocarbon fluid for recovery, and
- an injection system that inputs an injection fluid into the cavity for preventing or remediating hydrates inside said cavity, and wherein said injection system comprises, inside the cavity, a plurality of first injectors, each one of said plurality of first injectors is at a first distance from a dome inner surface lower than a first limit adapted to spray a quantity of the injection fluid onto said dome inner surface.

Thanks to these features, the injection system of the containment system according to the invention is very efficient for spraying injection fluid on the inner surface of the dome.

The hydrates may be firstly formed on the inner surface of the dome and at proximity of the output opening.

The hydrates are therefore prevented from forming on the inner surface of the dome.

If some hydrates are formed, the hydrates can not adhere to the inner surface of the dome, and can be evacuated through the output opening.

The needed quantity of injection fluid is reduced.

The risk of formation of hydrates is reduced.

The hydrates do not agglomerate and the clogging problem is avoided.

In various embodiments of the containment system, one and/or other of the following features may optionally be incorporated.

According to an aspect of the containment system, the first limit is lower than 20 centimeters, and preferably lower than 10 centimeters.

According to an aspect of the containment system, the plurality of first injectors cover said dome inner surface at a surface density higher than 3 per square meter, and preferably higher than 5 per square meter, and more preferably higher than 10 per square meter.

According to an aspect of the containment system, the plurality of first injectors cover a region of the dome inner surface around the upper output opening at an output density higher than said surface density.

According to an aspect of the containment system, the output density is higher than twice the surface density.

According to an aspect of the containment system, each one of the plurality of first injectors comprises dispersion means adapted to inject the injection fluid in a substantially semi spherical volume around said first injector.

According to an aspect of the containment system, the dispersion means comprises at least a feature of a list comprising a plurality of holes and a rotating head.

According to an aspect of the containment system, the injection system further comprises a plurality of second injectors, each one of said plurality of second injectors being of a different type compared to the first injectors and is at a second distance from the dome inner surface higher than a second limit, said second limit being higher than the first limit.

According to an aspect of the containment system, the second limit is higher than 30 centimeters, and preferably higher than 50 centimeters.

According to an aspect of the containment system, each one of the second injectors comprises a single axial hole adapted to inject the injection fluid in a substantially elongated volume in front of said second injector.

According to an aspect of the containment system, the elongated volume is a conic volume having a solid angle lower than 45°.

According to an aspect of the containment system, the injection system further comprises tuning means adapted to tune the second distance between the second injectors and the dome.

According to an aspect of the containment system, each tuning means comprises a portion of a conduit inside the cavity, between the inner surface of the dome and a second injector, said portion of a conduit being telescopic.

According to an aspect of the containment system, the injection system comprises:

- a first conduit for feeding the injection fluid to the plurality of first injectors, said first conduit being equipped with a first valve, and
- a second conduit for feeding the injection fluid to the plurality of second injectors, said second conduit being equipped with a second valve, and wherein the containment system comprises a control unit for controlling said first and second valves so as to control the flows of the injection fluid.

According to an aspect of the containment system, the plurality of second injectors is organised into a plurality of groups of second injectors, and wherein the injection system further comprises:

a manifold fed with the injection fluid by a second conduit, a plurality of circuits, each circuit being connected to the manifold and to one group of said plurality of groups of second injectors for feeding the injection fluid to said group, and wherein the manifold comprises a plurality of circuit valves, each circuit valve controlling a flow of injection fluid in a circuit of said plurality of circuits.

According to an aspect of the containment system, the containment system further comprises heating means for heating the injection fluid before injection inside the cavity by the injection system.

According to an aspect of the containment system, the injection fluid comprises one or a combination of the fluid components chosen in the list of water, an alcohol, an ethanol, a methanol, a glycol, an ethylene glycol, a diethylene glycol, and a low-dosage hydrate inhibitor (LDHI).

Another object of the invention is to provide a method for using a containment system for recovering hydrocarbon fluid from leaking hydrocarbon fluid from a well. The containment system comprises:

a dome situated above the leaking device and surrounding said leaking device, and forming a cavity under said dome, said cavity being adapted for accumulating hydrocarbon fluid coming upwardly from the leaking device, said dome comprising at least one upper output opening adapted to extract the hydrocarbon fluid for recovery, and an injection system that inputs an injection fluid into the cavity for preventing or remediating hydrates inside said cavity, and wherein said injection system comprises inside the cavity:

a plurality of first injectors, each one of said plurality of first injectors is at a first distance from a dome inner surface lower than a first limit adapted to spray a quantity of the injection fluid onto said dome inner surface.

The method of the invention comprises the following successive steps:

a) injecting an injection fluid inside the cavity by the first injectors of the injection system, and b) making the containment system go down towards and around the leaking device, at the seafloor.

Thanks to the above method, the containment system can be installed above the leaking device without having hydrate formation inside the cavity.

In preferred embodiments of the method proposed by the invention, one and/or the other of the following features may be optionally be incorporated.

According to an aspect of the method, the injection system further comprises a plurality of second injectors, each one of said plurality of second injectors being of a different type compared to the first injectors, and at step a) of the method, the injection fluid is also injected by the second injectors.

A maximum of injection fluid is therefore injected inside the cavity before being installed at the seafloor, i.e. during the transient phase of installation above the leaking device.

According to an aspect of the method, the method further comprises an injector positioning step, said injector positioning step being before step a) or after step b), and during which, each of the second injectors are positioned inside the cavity at a second distance from the dome inner surface higher than a second limit, said second limit being higher than the first limit.

The injection fluid is therefore sprayed inside most of the volume of the cavity.

According to an aspect of the method, the injection of the injection fluid to the second injectors simultaneously causes the second injectors to be positioned at said second distance from the dome inner surface.

BRIEF DESCRIPTION OF THE DRAWINGS

Other features and advantages of the invention will be apparent from the following detailed description of at least one of its embodiments given by way of non-limiting example, with reference to the accompanying drawings. In the drawings.

In the various figures, the same reference numbers indicate identical or similar elements. The direction Z is a vertical direction. A direction X or Y is a horizontal or lateral direction. These are indications for the understanding of the invention.

DETAILED DESCRIPTION OF THE DRAWINGS

Figure 1:
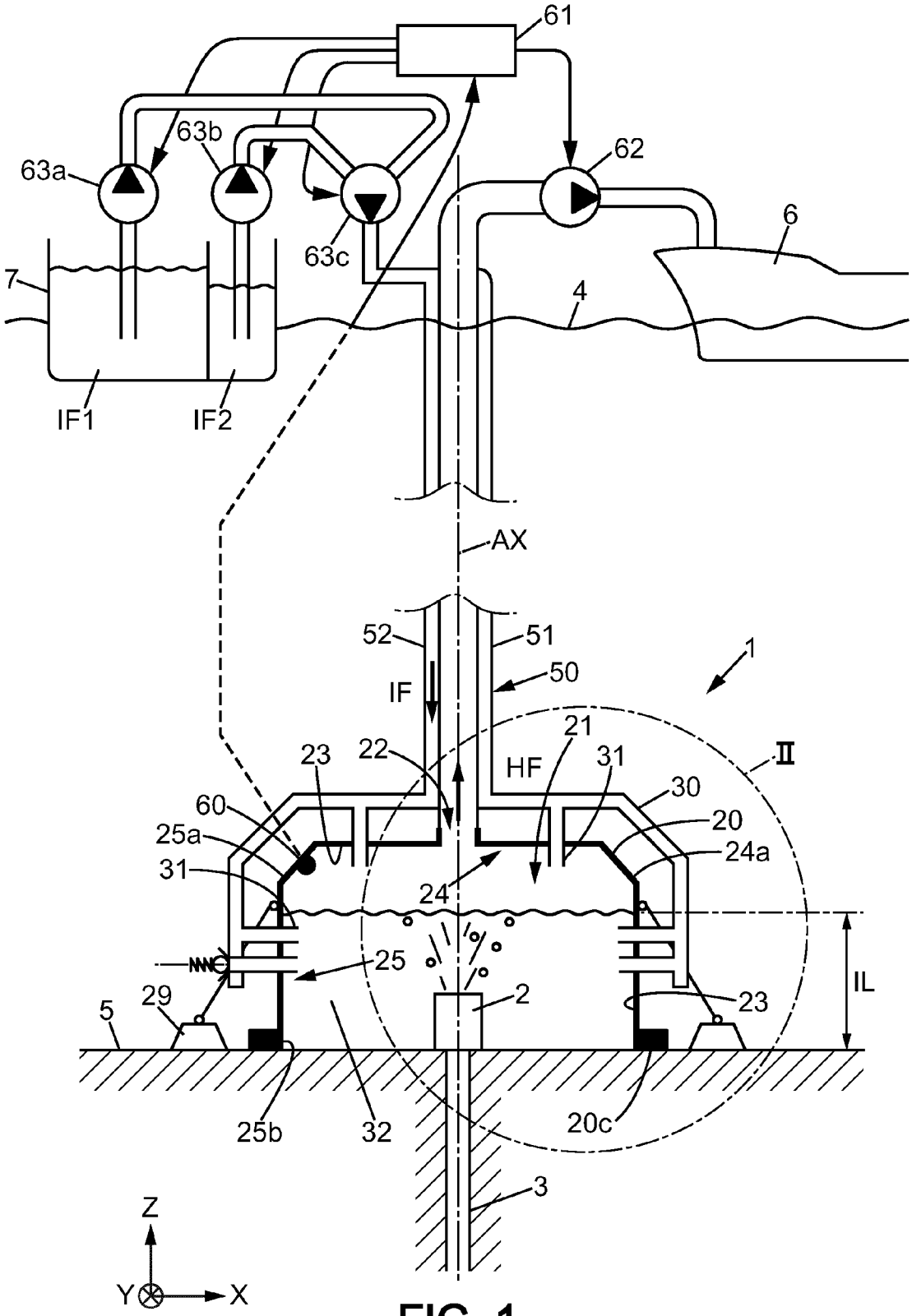
FIG. 1 is a schematic view of a vertical cut of a containment system according to a first embodiment of the invention.
Figure 2:
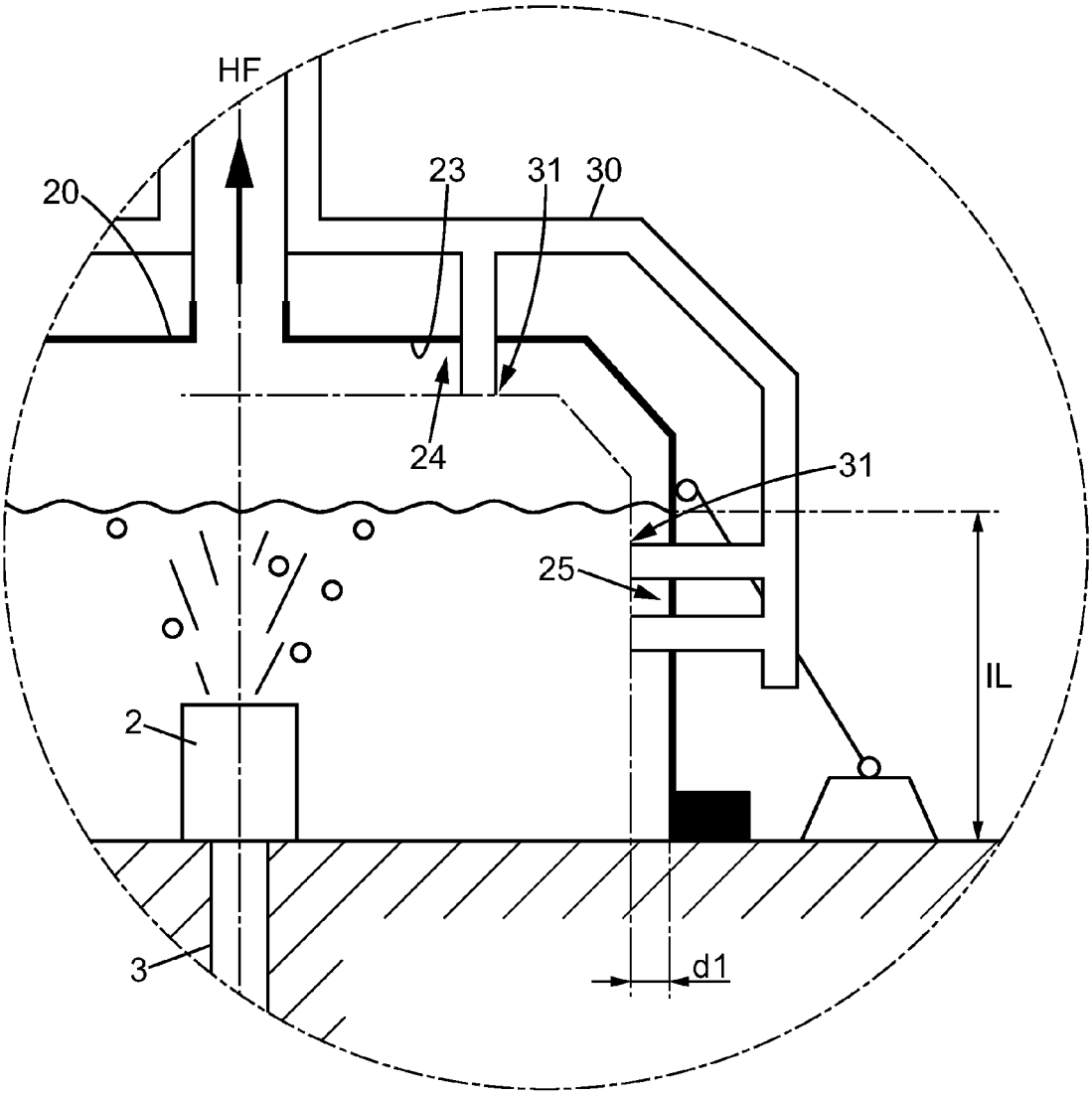
FIG. 2 is an enlarged view of a portion of the containment system of FIG. 2.

As shown on a first embodiment of the invention of FIGS. 1 and 2, the containment system 1 of present invention is adapted for recovering hydrocarbon fluid from a leaking device 2 that is situated at a seafloor 5 of a deep offshore installation. The leaking device 2 is for example the well itself, a pipeline, a blow out preventer device, a wellhead or any device connected to the wellhead. The leaking device 2 is therefore usually a large device. It may be larger than 5 m. The seafloor 5 is for example at more than 1500 meters deep below the sea surface 4. At this depth, the sea water is cold, for example around only 5° C. and at high pressure.

The hydrocarbon fluid may be liquid oil, natural gas, or a mix of them.

The leaking device 2 is leaking a hydrocarbon fluid from the subsea well 3. The hydrocarbon fluid exiting from the subsea may be rather hot, for example above 50° C. However, the environment cold temperature and the high pressure may transform the sea water and hydrocarbon fluid into hydrates having a quasi-solid or solid phase. These hydrates can fill and can clog any cavity.

The containment system 1 of present invention is landed and fixed to the seafloor by any means, such as anchoring or heavy weights 29 for compensating the upward Archimedes force applied on the containment system 1 by the hydrocarbon fluid that is lighter than the sea water (lower mass density). The seafloor corresponds in the present description to a base level of the containment system 1. The other levels are defined going upwards, in the vertical direction Z towards the sea surface 4.

The containment system 1 of present invention comprises at least:

- a dome 20 situated above the leaking device 2 and surrounding said leaking device, and forming a cavity 21 under said dome, said cavity being adapted for accumulating hydrocarbon fluid coming upwardly from the leaking device, said dome comprising at least one upper output opening 22 adapted to extract the hydrocarbon fluid for recovery, and
- an injection system 30 that inputs an injection fluid IF into the cavity for preventing the hydrocarbon fluid to form hydrates inside the cavity or for remediating hydrates inside the cavity.

The dome 20 is a hollow structure having:

- an upper portion 24 extending in a radial direction to an outer peripheral end 24*a*, said radial direction being perpendicular to the vertical direction AX, and
- a lateral portion 25 extending from the upper portion 24 downwardly between an upper end 25*a* and a lower end 25*b*, said lower end 25*b* comprising for example the foot 20*c*.

The lateral portion 25 has an inner diameter wider than a total width of the leaking device 2. For example, the inner diameter is of 6 meters or more.

The dome 20 comprises an upper output opening 22 having of small diameter compared to the dome diameter. Said upper output opening is adapted to be connected to a pipe 50 for extracting the hydrocarbon fluid from the containment system 1 to a recovery boat 6 at the sea surface 4, so as the hydrocarbon fluid is recovered.

In a vertical plane (XZ), the upper portion 24 of the dome 20 may have a convergent shape from the lateral portion 25 up to the upper output opening 22. The dome 20 is a cover that can have advantageously an inverted funnel shape.

The hollow structure of the dome 20 forms a largely opened cavity 21 in the direction to the seafloor. It is positioned above and around the wall 10. It is then above the leaking device 2 so as to accumulate the light hydrocarbon fluid.

The cavity 21 accumulates hydrocarbon fluid coming upwardly from the leaking device 2, i.e. oil and/or natural gas. The hydrocarbon fluid fills the upper volume of the cavity, down to an interface level IL. As the leaking device is usually large, the volume of the cavity 21 may be huge. For example, if the dome 20 is a cylinder of 9 m height and 9 m diameter, the volume is around 580 m3. This represents a huge quantity of hydrocarbon fluid (oil and gas) to be maintained inside the dome.

The injection system 30 of the containment system 1 according to the first embodiment of the invention comprises inside the cavity a plurality of first injectors 31.

The first injectors 31 are terminal devices, fixed at an end of a conduit. The conduit feeds the injector with a fluid (the injection fluid). The injector outputs the fluid as a spray into a sprayed region belonging to an output volume. The spray is composed of a collection of drops dispersed into said sprayed region. Injector characteristics (components, channels, and geometry of them) determine the shape of the sprayed region.

The first injectors 31 are distributed inside the cavity 21 so as each one of them is at a first distance d1 from the dome 20. The first distance from the dome is measured between a first injector 31 and an inner surface 23 of the dome that is the nearest from said first injector 31.

The first distance d1 of each one of the plurality of the first injectors 31 is lower than a first limit L1.

The first limit L1 has a small value so as all the first injectors 31 are situated inside the cavity 21 near the dome 20 (near the inner surface 23 of the dome) and so a quantity (a non-null quantity) of the injection fluid IF is sprayed onto the inner surface 23.

The first limit L1 may be null. In that case, all the first injectors 31 are situated on the inner surface 23 of the dome 20.

The first limit L1 has for example a value lower than 20 cm. Said value is preferably lower than 10 cm.

Thanks to the first injectors 31, a quantity of the injection fluid may be sprayed and spread regularly on the inner surface 23 of the dome 20. Hydrate formation and agglomeration on said inner surface 23 of the dome 20 can therefore be prevented.

The first injectors 31 may be distributed regularly in proximity of the inner surface 23 so as all the sprayed region of all of said first injectors 31 substantially cover most of said inner surface.

The first injectors 31 may be in a number enough in order that the spray covers said inner surface. For example, the number of said first injectors may be higher than 100, and preferably higher than 200.

The number of first injectors 31 is better defined as a surface density of them related to the inner surface 23. Their surface density is for example higher than 3 per square meter, and preferably higher than 5 per square meter, and more preferably higher than 10 per square meter.

The first injectors 31 around the upper output opening 22 may have an output density higher than the surface density. The surface density is determined with all the first injectors 31 of the containment system, and the output density is determined with the first injectors 31 around said upper output opening 22, for example the first injectors 31 located at a distance from the centre of the upper output opening 22 lower than twice the minimum value of distances between one first injector to another one of the first injectors 31.

The output density is for example higher than twice the surface density. The density of first injectors 31 around the upper output opening 22 is increased, and the injection fluid is sprayed around said upper output opening with a higher quantity compared to other portions of the inner surface 23. Hydrates formation and agglomeration around said upper output opening 22 is therefore more prevented.

Figure 3:
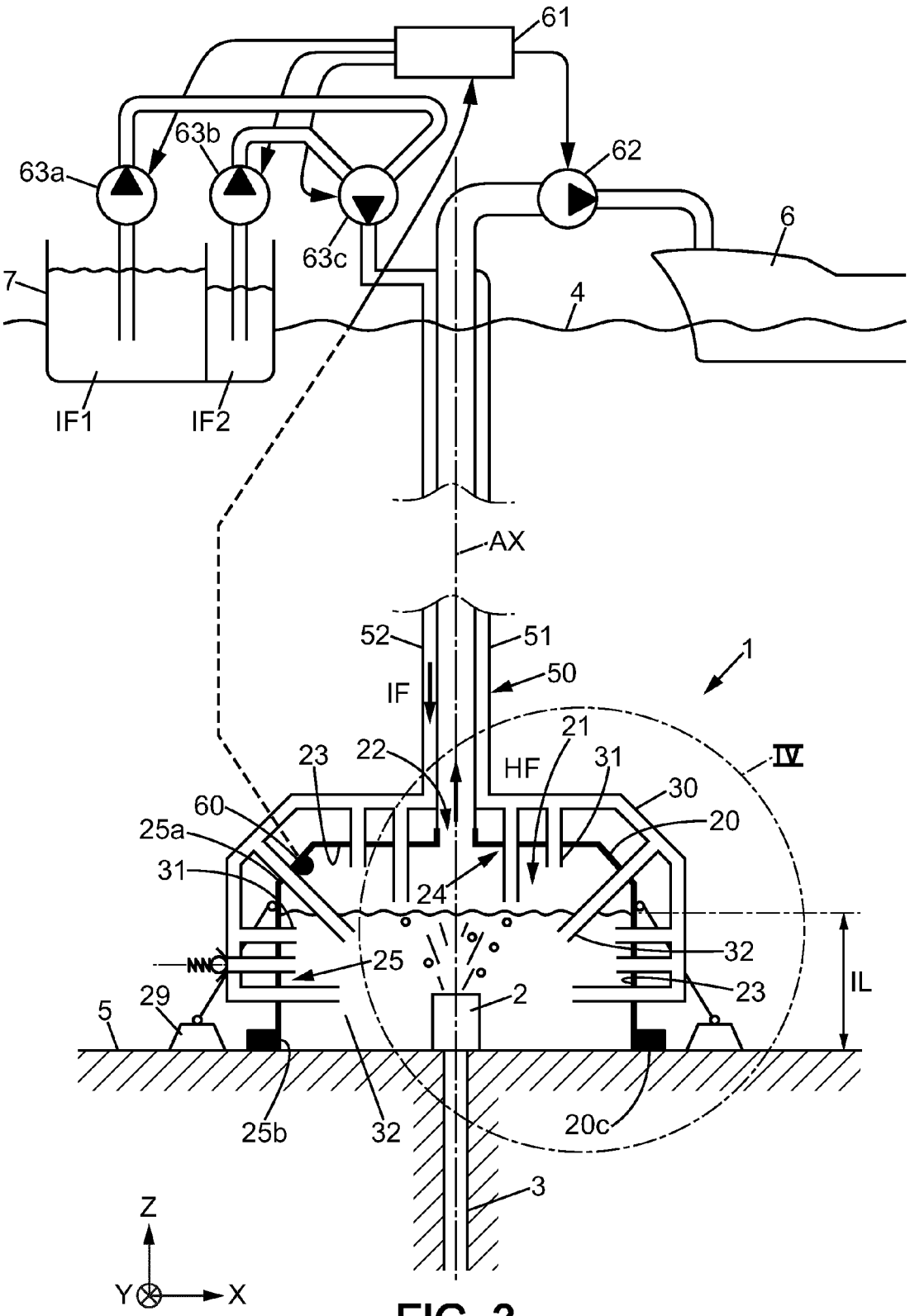
FIG. 3 is a schematic view of a vertical cut of a containment system according to a second embodiment of the invention.
Figure 4:
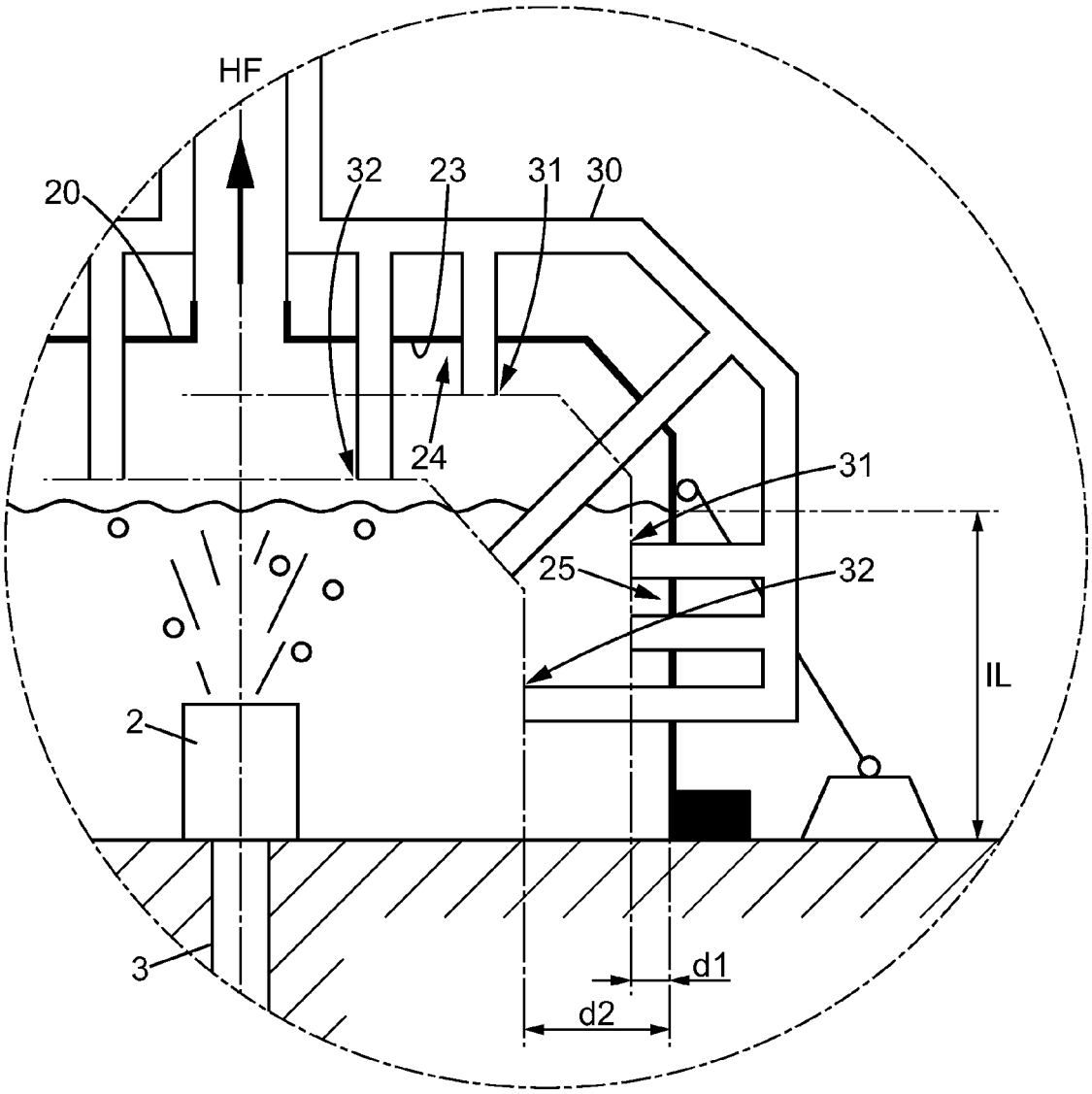
FIG. 4 is an enlarged view of a portion of the containment system of FIG. 3.

According to a second embodiment of the invention presented on FIGS. 3 and 4, similar to the first embodiment, the injection system 30 further comprises a plurality of second injectors 32.

Said second injectors 32 are also terminal devices, fixed at the end of a conduit to feed the injection fluid IF inside the cavity 21.

The second injectors 32 are distributed inside the volume of the cavity 21.

The second injectors 32 are distributed inside the cavity 21 so as each one of them is at a second distance d2 from the dome 20. The second distance from the dome is measured between a second injector 32 and an inner surface 23 of the dome that is the nearest from said second injector 32.

The second distance d2 of each one of the plurality of the second injectors 32 is higher than a second limit L2. The second limit L2 is itself higher than the first limit L1.

The second limit L2 has for example a value higher than 50 cm. The second limit L2 may be higher than 1 m or 2 m.

The second limit L2 has a value so as all the second injectors 32 are situated inside the cavity 21 and not near the dome 20. The second injectors 32 are therefore adapted for dispersing or spreading the injection fluid inside the volume of the cavity 21.

Thanks to the second injectors 32, the injection fluid may be sprayed and spread regularly inside the volume of the cavity 21. Hydrate formation and agglomeration inside said volume of the cavity 21 can therefore be prevented.

The second injectors 32 may be distributed regularly inside the volume of the cavity 21 so as all the sprayed region of all of the first and second injectors 31, 32 substantially cover most of said volume of the cavity 21.

The second injectors 32 may be positioned inside the cavity according to a level arrangement, each level corresponding to a second distance from the inner surface of the dome. The second injectors 32 may be organised into one or two level arrangements. The second level arrangement is at a backwards distance from the leaking device 2.

The second injectors 32 may be in a number that is for example higher or equal than 4, preferably higher or equal than 8, and preferably lower than 50

The second injectors 32 are spraying injection fluid inside the cavity 21, at a high flow so as to mix said injection fluid to the hydrocarbon fluid outputting from the leaking device 2. The flow may be as high as 10,000 barrel per day or more. This flow is controlled via at least one control valve, and preferably one global control valve and a plurality of circuit valves, each circuit valve controlling the flow inside a circuit feeding a group of second injectors. There may be 2 or 3 groups of second injectors 32, or more, each group having for example 4 to 8 second injector.

So as to cover and treat most of the volume of the cavity, the injection system 30 may comprise tuning means adapted to tune the second distance d2 of all or part of the second injectors 32. The tuning means may comprise for example a telescopic system to change or move the second injectors 32. For example, the conduits between the dome and the second injectors may be telescopic. The second injectors 32 can therefore be positioned inside the dome in taking into account the size and layout of the leaking device 2. The second injectors 32 can be positioned inside the dome 20 after the containment system 1 is installed at the seafloor 5 around the leaking device 2.

The tuning means can comprise any additional devices, like flexible conduits, and actuators to tune the second distance of each of the second injectors 32 or a second distance of groups of said second injectors 32. The actuators may be electric, hydraulic actuators. The pressure of the injection fluid may itself actuate the tuning means, and for example deploy the telescopic conduit supporting said second injectors 32. Otherwise, the means may be actuated by a remove operated vehicle (ROV).

In all embodiments of the invention, the containment system 1 may comprise one of the optional following features.

The containment system 1 advantageously comprises at least one sensor 60 for measuring the interface level IL of the fluid interface between sea water and the hydrocarbon fluid inside the dome 20.

The sensor 60 may give a first measurement of a liquid level corresponding to the interface level IL between the liquid component of the hydrocarbon fluid (e.g. oil) and the sea water, and a second measurement of a gas level corresponding to an interface between the liquid component and a gas component (e.g. natural gas) of the hydrocarbon fluid.

The containment system 1 additionally may comprise an output valve 62 connected to the upper output opening 22 and/or pipe 50 for outputting the recovered hydrocarbon fluid to the recovery boat 6.

Then, a control unit 61 calculates a control value on the basis of a measured value of the interface level IL, and operates the output valve 62 on the basis of the control value for outputting hydrocarbon fluid from the cavity 21. The control unit 61 may calculate the control value to keep the interface level IL at a constant level inside the cavity 21.

The injection fluid may be water, salted water, dead oil, an alcohol, an ethanol, a methanol, a glycol, an ethylene glycol, a diethylene glycol, and a low-dosage hydrate inhibitor (LDHI). Dead oil is degassed oil. The LDHI are fluids that include a mix of at a kinetic inhibitor fluid and an anti-agglomerant fluid. A kinetics inhibitor fluid is a fluid that delays the formation of hydrates. An anti-agglomerant fluid is a fluid that prevents the hydrates to agglomerates into large solids; only small hydrates are formed.

The injection fluid is stored inside a container 7 at the sea surface 4. A pump 63*c* extracts the injection fluid from the container 7, feeds a conduit down to the injection system 30. The container 7 may be included inside the recovery boat 6.

The pumped injection fluid may be heated by any heating means to improve its efficiency and prevent hydrate formation inside the cavity 21.

In case of an injection fluid that is water, the injection fluid is preferably heated to prevent the hydrate formation by the injection fluid itself.

The injection fluid may be composed of a mix of a plurality of fluids, e.g. a first injection fluid IF1 and a second injection fluid IF2, each of them stored into independent compartments of the container 7. Independent pumps 63*a*, 63*b* extract the needed quantities of each of first and second injection fluids to produce the mix of fluids. The mix may be adapted in real time and may depend on installation process of the containment system 1 above the leaking device 2, or on measurements done inside the cavity 21 during hydrocarbon fluid recovery (temperature, fluid composition . . . ).

As explained for the output valve 62, the control unit 61 is controlling the pumps 63*a*, 63*b*, 63*c* for extracting the injection fluid from the container 7.

The pipe 50 is advantageously a two concentric tubes pipe, having an inner pipe 51 forming an inner channel, and an outer tube 52 surrounding said inner pipe 51 and forming an annular channel between the inner tube and the outer tube. The inner channel may be connected to the upper output opening 22 and used to extract the hydrocarbon fluid from the cavity 21. The annular channel may be therefore connected to the injection system 30, and used to feed it with the injection fluid. However, it is apparent that the two channel of such pipe can be connected to the dome according to the other inverse possibility without any change.

Additionally, the injection system 30 may feed the first injectors 31 and second injectors 32 via different hydraulic circuits (first circuit and second circuit). Optionally each of them may be equipped with a valve (first valve and second valve respectively) so as the control unit 61 is able to control the flow of injection fluid to the first and second injectors 31, 32.

The quantity of injection fluid being sprayed by each of the first and second injectors 31, 32 may be tuned precisely, and modified during operations. Hydrate formation may be prevented more efficiently.

Additionally, the injection system 30 may also feed the second injectors 32 via different hydraulic circuits, each circuit feeding a group of second injectors 32. The injection system 30 may comprises a manifold fed with the injection fluid and feeding said injection fluid to each group of second injectors. The plurality of circuits is therefore connected to the manifold. The manifold comprises a plurality of circuit valves, each circuit valve controlling a flow of the injection fluid into one circuit of said plurality of circuits.

The quantity of injection fluid being sprayed by each group of the second injectors 32 may be tuned precisely, and modified during operations. Hydrate formation may be prevented more efficiently.

The containment system 1 may comprise other output openings and/or pipes for feeding additionally fluids, or for extracting other fluids, liquid or gases from the cavity.

For example, the containment system 1 may comprise a drain valve for purging or limiting the quantity of water inside the cavity 21.

Advantageously, the cavity 21 can be used as a phase separator for separating the water and the hydrocarbon fluid, and for separating each phase of the hydrocarbon fluid (oil, gas) so as to extract them separately.

The upper portion 24 of the dome 20 may comprise output openings, called vents, for evacuating large quantities of fluid inside the cavity 21. These vents are helpful to facilitate the installation of the containment system 1 above the leaking device 2. The vents are opened during the first transient steps of installation, noticeably when the containment system 1 is made to go down to the seafloor 5 around the leaking device 2. During these steps all the hydrocarbon fluid may be evacuated to cancel its Archimedes force on the containment system and to prevent hydrate formation problem.

Moreover, the dome 20 may comprises upper and lateral portions 24, 25 that comprise thermal isolating material, so as to thermally isolate the cavity 21 from the cold environment of sea water. Ideally, the thermally isolating material has a thermal conductivity lower than 0.1 $W \cdot m^{-1} \cdot K^{-1}$.

The following thermal isolation materials may be used: synthetic material such as Polyurethane (PU) or polystyrene material, or a fibre textile with Polyvinyl chloride (PVC) coating or PU coating, or Alcryn®. The thermal isolation material may be foam, or a gel contained inside a double wall structure.

The wall 10 and dome 20 may comprise a plurality of walls, layers or envelopes for improving the thermal isolation. Between the layers, isolation materials may be included, or heating devices (electric, hydraulic or of any kind) to improve again the thermal isolation of the wall and/or dome.

The thermal isolation of the dome 20 passively isolates the cavity 21, while the first injection device 30 actively isolates the cavity 21. Both effects prevent the formation of hydrates inside the cavity 21.

Figure 5:
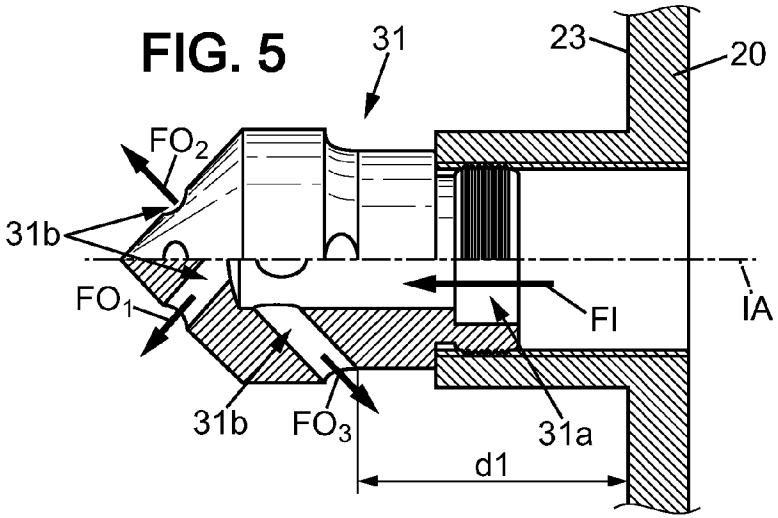
FIG. 5 is an example of a first injector used in the containment system.

The FIG. 5 is presenting an example of a first injector 31. Said first injector 31 can be screwed at the end of a circuit conduit of the injection system 30.

This first injector 31 comprises:

- one input hole 31*a* fed with an input flow FI of injection fluid, and
- a plurality of output holes 31*b* for outputting output flows $FO_1$, $FO_2$ and $FO_3$.

The output holes 31*b* are directed to various directions relative to the injector axis IA. The sprayed volume of such injector nozzle is a quasi semi-spherical volume around the injector 31.

According to a variant, the first injector 31 may comprise a rotating head to spray the injection fluid according to a semi-spherical volume around the first injector 31.

Such first injector 31 is positioned at a first distance d1 from the dome inner surface 23. Said first distance d1 is for example defined as the lowest distance between all the output holes 31*b* of the first injector 31 and the inner surface 23, as it is represented on FIG. 5.

Figure 6:
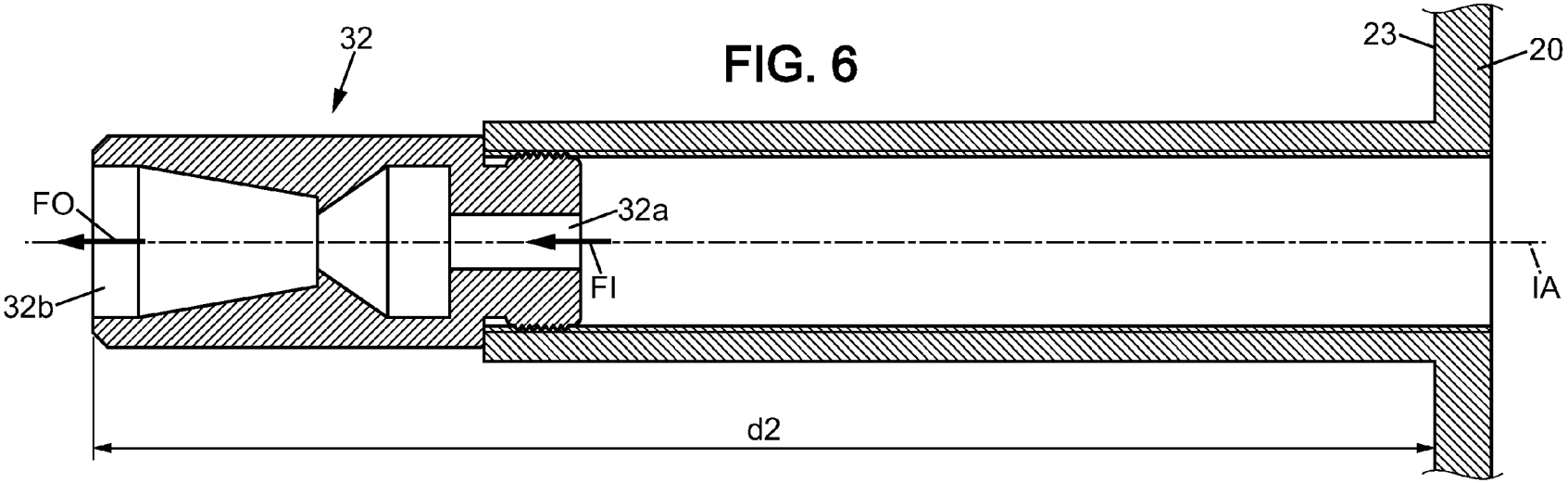
FIG. 6 is an example of a second injector used in the containment system.

The FIG. 6 is presenting an example of a second injector 32. Said second injector 32 can be screwed at the end of a circuit conduit of the injection system 30.

This second injector 32 comprises:

- one input hole 32*a* fed with an input flow FI of injection fluid, and
- one output hole 32*b* for outputting output flow FO.

The output hole 32*b* comprises a conic portion having a diameter increasing in the direction of the output. The direction is substantially parallel to the injector axis IA. The sprayed volume of such injector nozzle is an elongated in the direction of the injector axis IA.

The sprayed volume may have a general conic shape, having for example a solid angle lower than 5°.

Such second injector 32 is positioned inside the cavity 21 at a second distance d2 from the dome inner surface 23. Said second distance d2 is for example defined as the distance between the output hole 32*b* and the inner surface 23, as represented on FIG. 6.

Figure 7:
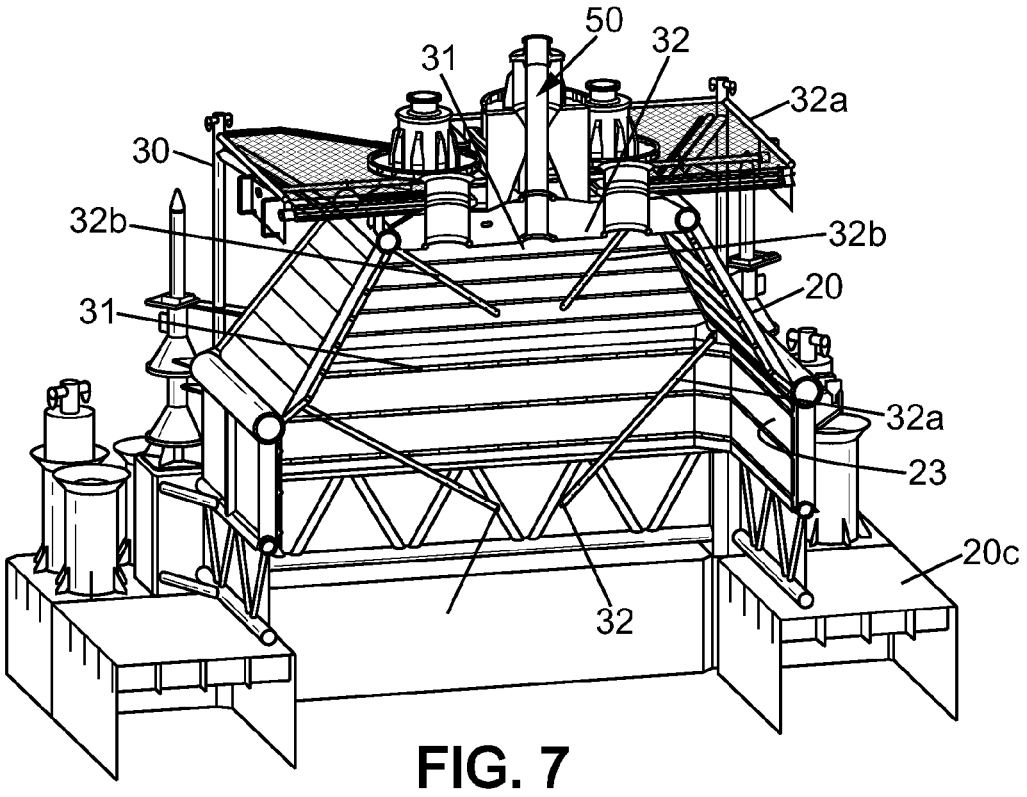
FIG. 7 is a cut perspective view of the containment system of FIG. 3.
Figure 8:
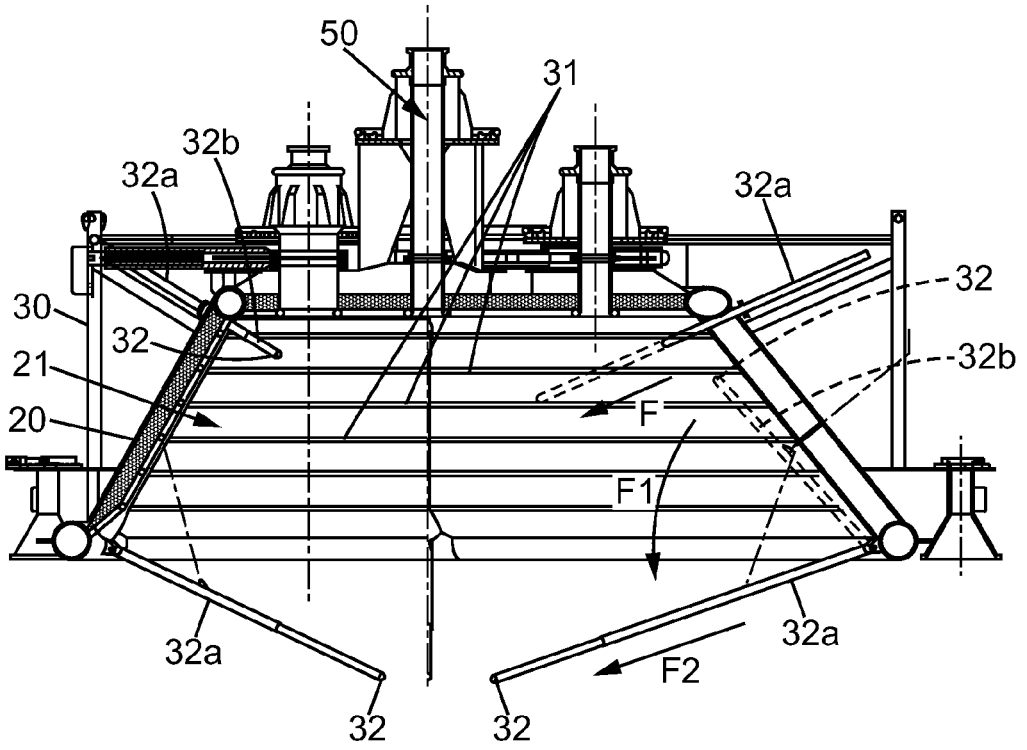
FIG. 8 is a view of a vertical cut of the containment system of FIG. 7.

FIGS. 7 and 8 show a more precise design of the containment system according to the second embodiment of the invention. On these figures, the first and second injectors 31, 32 are shown.

The first injectors 31 are positioned along peripheral conduits situated on the inner surface 23 of the upper portion 24 of the dome. These peripheral conduits are for example extending according to a plurality of rings at several layers in a vertical direction. These rings are surrounding at least the upper portion of the cavity. These peripheral conduits are fed through feeding conduits, for example also used as structural elements of the dome 20.

The second injectors 32 are mounted at the inner end of telescopic conduits. These telescopic conduits extend inwards from the inner surface 23 of the dome 20. They are tilted relative to a horizontal plane XY of an angle comprised between 30° and 60°. All the telescopic conduits are therefore oriented towards the leaking device 2.

The telescopic conduits comprise a first portion of a larger diameter, and a second portion of a narrower diameter, said second portion being sealingly movable inside the first portion, like a piston. The second portion can translate inside the first portion between a retracted position (on upper left side of FIG. 8) and a deployed position (on upper right side of FIG. 8).

The second injectors 32 and their telescopic conduits are for example organised in two groups:

- a first group situated near the upper portion 24 of the dome 20 having a first portion 32*a* fixed to the dome and also extending outside of the dome, and a second portion 32*b* extending inside the dome and movable towards the leaking device (arrow F); and
- a second group situated below the first group, and having a first portion 32*a* rotatably mounted to the dome and being entirely situated inside the cavity 21 of the dome, and a second portion 32*b* extending inside the dome 20.

For the second group, the telescopic conduit is deployed in two steps:

- Firstly, the first portion 32*a* and the second portion 32*b* in the retracted position are rotated to be oriented inwards, in the direction of the leaking device 2 (arrow F1); and
- Secondly, the second portion 32*b* is moved from the retracted position to the deployed position (arrow F2).

The telescopic conduits are therefore advantageously deployed in their final position (deployed position) after the landing of the containment system 1 on the seafloor 5.

The method for using or installing the containment system 1 according to the invention is now explained.

The containment system 1 comprises an injection system 30 comprising inside the cavity:

a plurality of first injectors 31, each one of said plurality of first injectors 31 is at a first distance from a dome inner surface lower than a first limit adapted to spray a quantity of the injection fluid onto said dome inner surface.

The method comprises the following successive step:

a) injecting an injection fluid inside the cavity by the first injectors 31 of the injection system 30, and b) making the containment system go down towards and around the leaking device, down to the seafloor.

The dome 20 is preferably entirely filled with the injection fluid before step b).

The containment system 1 is preferably:

b1) made to go down near the seafloor laterally aside from the leaking device 2, so as no hydrocarbon fluid is accumulated inside the dome 20 too early inside the dome, and so as no hydrates are formed; and b2) moved laterally near the seafloor to be settled around the leaking device 2, and then seated on the seafloor or a previously installed base.

The hydrocarbon fluid leaking from the leaking device 2 is then rapidly in contact with the injection fluid already present inside the cavity 21 of the containment system 1. The hydrates formation during the installation procedure is therefore efficiently prevented.

Thanks to the above method, the volume of the cavity 21 is fed with the injection fluid before the containment system 1 is installed at the seafloor, around the leaking device. This transient installation period is critical or sensitive for the hydrate formation. If the dome 20 already comprises hydrates before the containment system is installed at the seafloor, it will be difficult to remediate them after. The method ensures that the inner surface of the dome and its output opening does not have the hydrates agglomerated.

Then, the hydrocarbon fluid may be extracted from the dome 20 via the upper output opening 22. A level of hydrocarbon fluid (interface level) may be controlled by the output valve 62, sensor 60 and control unit 61.

If the injection system 30 further comprises a plurality of second injectors 32, each one of said plurality of second injectors 32 being of a different type compared to the first injectors, then at step a) of the method, the injection fluid could also be injected by the second injectors 32.

The quantity of injection fluid is increased. The injection fluid is also spayed inside the volume of the dome. The hydrocarbon fluid is better mixed with the injection fluid. The hydrates formation is more efficiently prevented.

The method may also comprise an injectors positioning step, said injectors positioning step being before step a) or after step b), and during which, each of the second injectors 32 are positioned inside the cavity at a second distance from the dome inner surface higher than a second limit, said second limit being higher than the first limit.

The second injectors are positioned inside the volume of the cavity so as injection fluid is sprayed in most of said volume of the cavity.

Additionally, the injection of the injection fluid to the second injectors 32 is eventually making the second injectors 32 to be positioned at said second distance from the dome inner surface. The pressure of said injection fluid is then actuating a tuning means (such as a telescopic conduit) for positioning said second injectors 32 at predetermined positions that are adapted to ensure that hydrate formation is efficiently prevented.

The embodiments above are intended to be illustrative and not limiting. Additional embodiments may be within the claims. Although the present invention has been described with reference to particular embodiments, workers skilled in the art will recognize that changes may be made in form and detail without departing from the spirit and scope of the invention.

Various modifications to the invention may be apparent to one of skill in the art upon reading this disclosure. For example, persons of ordinary skill in the relevant art will recognize that the various features described for the different embodiments of the invention can be suitably combined, un-combined, and re-combined with other features, alone, or in different combinations, within the spirit of the invention. Likewise, the various features described above should all be regarded as example embodiments, rather than limitations to the scope or spirit of the invention. Therefore, the above is not contemplated to limit the scope of the present invention.

The invention claimed is:

1. A containment system for recovering a hydrocarbon fluid from a leaking device that is situated at the seafloor and that is leaking hydrocarbon fluid from a well, wherein the containment system comprises:

a dome situated above the leaking device and surrounding said leaking device, and forming a cavity under said dome, said cavity being adapted for accumulating hydrocarbon fluid coming upwardly from the leaking device, said dome comprising at least one upper output opening adapted to extract the hydrocarbon fluid for recovering, and an injection system that inputs an injection fluid into the cavity for preventing or remediating hydrates inside said cavity, and wherein said injection system comprises inside the cavity a plurality of first injectors, each one of said plurality of first injectors is at a first distance from a dome inner surface lower than a first limit adapted to spray a quantity of the injection fluid onto said dome inner surface and a plurality of second injectors, each one of said plurality of second injectors being of a different type compared to the first injectors and is at a second distance from the dome inner surface higher than a second limit, said second limit being higher than the first limit.

2. The containment system according to claim 1, wherein the first limit is lower than 20 centimeters, and preferably lower than 10 centimeters.

3. The containment system according to claim 1, wherein the plurality of first injectors cover said dome inner surface at a surface density higher than 3 per square meter, and preferably higher than 5 per square meter, and more preferably higher than 10 per square meter.

4. The containment system according to claim 3, wherein the plurality of first injectors cover a region of the dome inner surface around the upper output opening at an output density higher than said surface density.

5. The containment system according to claim 4, wherein the output density is higher than twice the surface density.

6. The containment system according to claim 1, wherein each one of the plurality of first injectors comprises dispersion means adapted to inject the injection fluid in a substantially semi spherical volume around said first injector.

7. The containment system according to claim 6, wherein the dispersion means comprising a plurality of holes and a rotating head.

8. The containment system according to claim 1, wherein the second limit is higher than 50 centimeters.

9. The containment system according to claim 1, wherein each one of the second injectors comprises a single axial hole adapted to inject the injection fluid in a substantially elongated volume in front of said second injector.

10. The containment system according to claim 9, wherein the elongated volume is a conic volume having a solid angle lower than 45°.

11. The containment system according to claim 1, wherein the injection system further comprises tuning means adapted to tune the second distance between the second injectors and the dome.

12. The containment system according to claim 11, wherein each tuning means comprises a portion of a conduit inside the cavity, between the inner surface of the dome and a second injector, said portion of a conduit being telescopic.

13. The containment system according to claim 1, wherein the injection system comprises:

a first conduit for feeding the injection fluid to the plurality of first injectors, said first conduit being equipped with a first valve, and a second conduit for feeding the injection fluid to the plurality of second injectors, said second conduit being equipped with a second valve, and wherein the containment system comprises a control unit for controlling said first and second valves so as to control the flows of the injection fluid.

14. The containment system according to claim 1, wherein the plurality of second injectors is organised into a plurality of groups of second injectors, and wherein the injection system further comprises:

a manifold fed with the injection fluid by a second conduit, a plurality of circuits, each circuit being connected to the manifold and to one group of said plurality of groups of second injectors for feeding the injection fluid to said group, and wherein the manifold comprises a plurality of circuit valves, each circuit valve controlling a flow of injection fluid in a circuit of said plurality of circuits.

15. The containment system according to claim 1, further comprising heating means for heating the injection fluid before injection inside the cavity by the injection system.

16. The containment system according to claim 1, wherein the injection fluid comprises one or a combination of the fluid components chosen in the list of water, salt water, dead oil, an alcohol, an ethanol, a methanol, a glycol, an ethylene glycol, a diethylene glycol, and a low-dosage hydrate inhibitor.

17. A method for using a containment system for recovering hydrocarbon fluid from a leaking device that is situated at the seafloor and that is leaking hydrocarbon fluid from a well, and wherein the containment system comprises:

a dome situated above the leaking device and surrounding said leaking device, and forming a cavity under said dome, said cavity being adapted for accumulating hydrocarbon fluid coming upwardly from the leaking device, said dome comprising at least one upper output opening adapted to extract the hydrocarbon fluid for recovery, and an injection system that inputs an injection fluid into the cavity for preventing or remediating hydrates inside said cavity, and wherein said injection system comprises inside the cavity:

a plurality of first injectors, each one of said plurality of first injectors is at a first distance from a dome inner surface lower than a first limit adapted to spray a quantity of the injection fluid onto said dome inner surface, and a plurality of second injectors, each one of said plurality of second injectors being of a different type compared to the first injectors, and wherein the method comprises the following successive step:

a) injecting an injection fluid inside the cavity by the first injectors and by the second injectors, and b) disposing the containment system to go down towards and around the leaking device, on the seafloor.

18. The method according to claim 17, further comprising an injector positioning step, said injector positioning step being before step a) or after step b), and during which, each of the second injectors are positioned inside the cavity at a second distance from the dome inner surface higher than a second limit, said second limit being higher than the first limit.

19. The method according to claim 18, wherein the injection of the injection fluid to the second injectors simultaneously causes the second injectors to be positioned at said second distance from the dome inner surface.

* * * * *